US011246354B2

(12) United States Patent
Blecha et al.

(10) Patent No.: US 11,246,354 B2
(45) **Date of Patent: *Feb. 15, 2022**

(54) BREAST SUPPORT GARMENT

(71) Applicant: LULULEMON ATHLETICA CANADA INC., Vancouver (CA)

(72) Inventors: Joseph Simon Blecha, Lake Oswego, OR (US); Kristen Elizabeth Barnes, Vancouver (CA); Jessica Lee Croll, Pemberton (CA); Jillian Lindsay Rothert, New Westminster (CA); John Makowsky, Vancouver (CA); Connor Alexander Hammond, Vancouver (CA); Erica Margaret Buckeridge, Vancouver (CA); Nadine Boudreau-Béland, Vancouver (CA); Krystal Lindsey Howard, Vancouver (CA); Simon Quay, Portland, OR (US); Ariana Budner Manesh, Portland, OR (US); Aislinn Tan, Portland, OR (US)

(73) Assignee: LULULEMON ATHLETICA CANADA INC.

( * ) Notice: Subject to any disclaimer, the term of this patent is extended or adjusted under 35 U.S.C. 154(b) by 112 days.

This patent is subject to a terminal disclaimer.

(21) Appl. No.: 16/592,177

(22) Filed: Oct. 3, 2019

(65) Prior Publication Data

US 2020/0288792 A1 Sep. 17, 2020

Related U.S. Application Data

(63) Continuation of application No. 16/351,451, filed on Mar. 12, 2019, now Pat. No. 10,477,902.

(51) Int. Cl.
*A41C 3/00* (2006.01)
*A41C 3/12* (2006.01)

(52) U.S. Cl.
CPC ..... *A41C 3/0057* (2013.01); *A41C 3/12* (2013.01); *A41C 3/0007* (2013.01)

(58) Field of Classification Search
CPC ..... A41C 3/00; A41C 3/12; A41C 3/0057
(Continued)

(56) References Cited

U.S. PATENT DOCUMENTS 6,165,045 A 12/2000 Miller et al.
7,435,155 B2 10/2008 Reinisch et al.
(Continued)

FOREIGN PATENT DOCUMENTS

CA 2809902 A1 9/2012
EP 2153739 B1 2/2010

OTHER PUBLICATIONS

Wakefield-Scurr, The Ceramic Bra, Bra Science dated Aug. 14, 2018, 3 pgs.

(Continued)

*Primary Examiner* — Gloria M Hale
(74) *Attorney, Agent, or Firm* — Bracewell LLP; Douglas F. Stewart; Patrick J. Connolly

(57) ABSTRACT

This invention relates to a breast support garment for use in active environments, where the wearer of such garment is engaged in an activity that results in accelerating movements. In some preferred embodiments, these garments may be athletic or sports bras that redirect momentum related to a wearer's accelerating movements, for example, during exercise.

25 Claims, 10 Drawing Sheets

(58) Field of Classification Search
USPC ..... 450/39, 40, 86
See application file for complete search history.

(56) References Cited

U.S. PATENT DOCUMENTS

| | | | | |
|---|---|---|---|---|
| 7,833,082 | B2 | 11/2010 | Bugada | |
| 8,128,457 | B2 | 3/2012 | Reinisch et al. | |
| 8,480,452 | B2 | 7/2013 | Reinisch et al. | |
| 8,690,634 | B2 * | 4/2014 | Heath | A41C 3/0057 450/41 |
| 8,915,764 | B2 | 12/2014 | Scott et al. | |
| 9,480,287 | B2 * | 11/2016 | Black | A41F 15/007 |
| 9,538,794 | B2 * | 1/2017 | Turlan | D04B 1/246 |
| 2003/0082994 | A1 * | 5/2003 | Mitchell | A41C 3/0007 450/74 |
| 2003/0171066 | A1 * | 9/2003 | Mitchell | A41C 5/00 450/66 |
| 2006/0240743 | A1 * | 10/2006 | Mitchell | D04B 1/02 450/1 |
| 2007/0021035 | A1 * | 1/2007 | Bugada | A41C 3/0014 450/39 |
| 2009/0081924 | A1 * | 3/2009 | Puyaubreau | A41C 3/0057 450/39 |
| 2010/0068972 | A1 | 3/2010 | Hendrickson | |
| 2011/0212668 | A1 * | 9/2011 | Mitchell | D04B 1/246 450/86 |
| 2016/0360801 | A1 | 12/2016 | Sze et al. | |
| 2017/0119063 | A1 | 5/2017 | Diaz et al. | |
| 2017/0290376 | A1 | 10/2017 | Maheshwari et al. | |
| 2018/0035724 | A1 | 2/2018 | Blibech | |
| 2018/0242653 | A1 | 8/2018 | Brandt et al. | |

OTHER PUBLICATIONS

Wakefield-Scurr, Clover RD Presentation, Clover Group International Limited, Aug. 2018.

* cited by examiner

BREAST SUPPORT GARMENT

CROSS REFERENCE TO RELATED APPLICATIONS

This application is a continuation application of U.S. application Ser. No. 16/351,451, filed on Mar. 12, 2019 now U.S. Pat. No. 10,477,902 and Ser. No. 16/657,203.

FIELD OF INVENTION

This invention relates to breast support garments for use in active environments where the wearer of such garment is engaged in an activity that results in accelerating movements of the breast tissue. In some embodiments, these breast support garments may be athletic or sports bras that redirect momentum related to wearer's breast accelerating movements, for example, during exercise.

BACKGROUND OF THE INVENTION

Typical athletic or sports bras are designed to restrict the movement of breast tissue related to high-impact exercise by uniformly compressing the breast tissue to the wearer's chest utilizing stiffer fabrics and large number of components to lock down the breast tissue. While the uniform compression effected by a typical athletic or sports bra may provide adequate movement management of the breast tissue, this compression can also be uncomfortable for the wearer because it does not effectively distribute the pressure around the wearer's torso. FIG. 1 shows an example of typical sports bra 10 that comprises a compressive overall fabric 12, reinforced straps and arm holes 14 and a reinforced underband 16. A typical athletic or sports bra compresses the apex of the wearer's breast tissue to the wearer's chest, and is not designed to account for any specific movement or acceleration direction of the breast tissue resulting from the wearer's activity. By failing to provide precise management of the breast tissue around the perimeter of the breast, and failing to distribute pressure in more comfortable fashion, a typical athletic or sports bra does not effectively maximize the balance between maintaining the comfort of the wearer and managing movement of the wearer's breast tissue.

There exists a need for breast support garments that provide more precise management of the acceleration and movement of breast tissue during high-impact exercise, while distributing pressure in a way that is more comfortable for the wearer of the garment.

SUMMARY OF THE INVENTION

In one aspect, a breast support garment is provided. The garment comprises a front panel covering at least a portion of a wearer's chest, a pair of straps and a reinforcing frame with a front reinforcement structure connected to the front panel defining two breast areas to support breast tissue directly around a root of each breast. The front reinforcing structure comprises a central reinforcing element with two crisscrossing legs that extend from a chest region of one of the breast to an under-breast region of an opposite breast thus separating the two breast areas. Each of the leg of the central reinforcing element has a top end in contact to a respective strap. The reinforcing frame is configured to allow the wearer's breasts move independently one from another.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION

The present invention provides a garment that distributes pressure in a way that is comfortable for the wearer while also effectively managing and reducing movement and acceleration of the wearer's breast tissue. In some implementations, the athletic garment of the present invention can provide a zoned functional support and decoupled management of breast movement and reduction of breast tissue's acceleration.

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Figure 1:
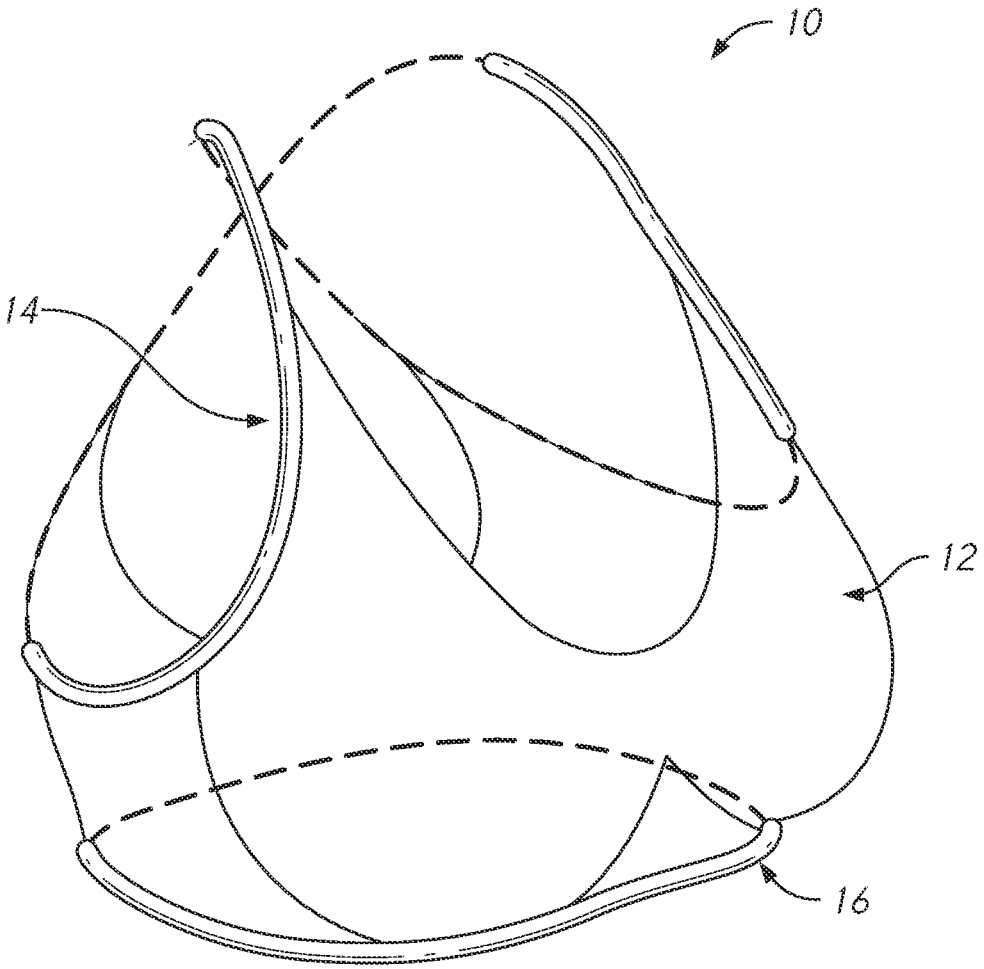
FIG. 1 (PRIOR ART)
FIG. 1 is an isometric perspective view of a typical prior art sports bra.
Figure 2:
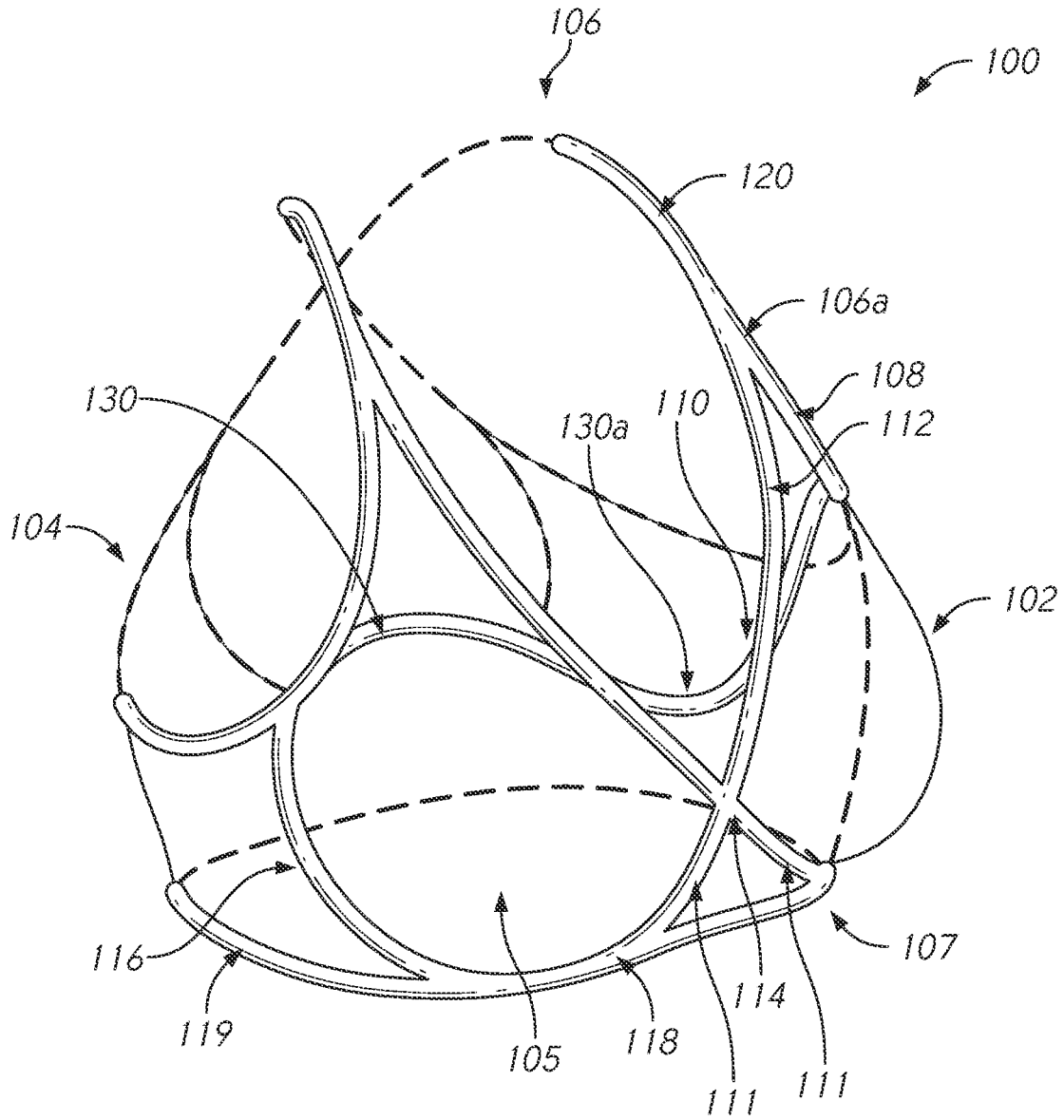
FIG. 2 is an isometric perspective view of an example embodiment of a breast support garment showing a reinforcing frame with a central reinforcement element and a superior/inferior control band.

FIG. 2 illustrates an example of a breast support garment 100 that includes a front panel 102, a back panel 104, a pair of straps 106 and a reinforcing frame 108. The reinforcing frame 108 can comprise a front reinforcing structure 107 connected to the front panel 102 and a back reinforcing structure 109 connected to the back panel 104 (see FIG. 5). The front reinforcing structure 107 can be bonded to the outer or the inner surface of the front panel or it can be a middle layer in a laminated type of a front panel. The front reinforcing structure 107 follows the contours of each breast such that a breast tissue is supported directly around a root of each breast and can comprise a central reinforcing element 110 that can include two crisscrossing legs 111 that extend from a chest region 112 of one of the breast to an under-breast region 118 of an opposite breast thus separating the two breast areas 105. The applicant defines the crisscrossed legs 111 as a portion of the central reinforcing element 110 that extends from a front end 106*a* of each of the straps 106 traverses across a central region 114 between the two breast areas 105 and under the breast region 118 of the opposite breast following the contours of such breast around the root of the breast tissue. Such central reinforcing element 110 defines the breast areas 105 and provides direct linear connection between each breast and an opposite strap supporting the breast tissue in mediolateral direction (side to side) as well as in vertical direction (up-down), such that the breasts are fully supported during activity. The reinforcing frame 108 reinforces and supports the breast tissue during activity by dampening acceleration of the breast tissue in mediolateral and vertical directions generally without intense compression of the breast tissue.

The front reinforcing structure 107 can have a first structural property to provide a first amount of support while the back reinforcing structure 109 (FIG. 5) can have a second structural property to provide a second amount of support. For example, the front reinforcing structure 107 can be more rigid and the back reinforcing structure 109 can have a higher degree of stretch, such that the pressure applied around the breast tissue by the front reinforcing structure 107 is greater than the support provided by the back reinforcing structure 109. In one implementation, the reinforcing frame 108 can be engineered to have a modular structure with a number of modules with structural properties that vary depending on their position as well as unique physical and behavioral features of the wearer such as for example wearer's unique anatomy e.g. breast shape, breast movement pattern during sport activity, etc.). The variation of the modules' values across the garment 100 contributes to its ability to control accelerating movements of the wearer's breast tissue. For example, the central reinforcing element 110 can provide a higher degree of support around the periphery of the breast tissue than the underband 119 or the straps 106. The front reinforcing structure 107 can be shaped to conform wearer's unique breast shape or its modular structure can be engineered to meet wearer's needs depending on the wearer's unique breast movement pattern.

The reinforcing frame 108 can have modular structure engineered such that it can include a chest or top module in the chest region 112 on the top of each breast, a central module in the region 114 between the breasts, a lateral module in a lateral region 116 (on the lateral side of each breast), a base module in the under-breast region 118. The reinforcing frame 108 can also include a strap module in a front and back strap region 120. The chest module, the central module, the lateral module and the base module, as well as portion of the strap module (at the front part of the torso), are part of the front reinforcing structure 107, while the portion of the strap module, the back straps module, is part of the back reinforcing structure 109. In one embodiment, the under band 119 can also be part of the reinforcing frame 108. In one implementation, the back reinforcing structure 109 can comprise the back portion of the straps and the back portion of the under band 119, while the back panel 104 can be omitted (see FIG. 5). In one implementation, the chest region 112 of the front reinforcing structure 107 can further include a superior/inferior control band 130 to further reinforce the chest region 112 for managing and dampening the acceleration of the breast in vertical direction, during sport activity such as running or jumping. The superior/inferior control band 130 can be integral with the central reinforcing element 110. More than one superior/inferior control band adjacent to or separated one from another can be provided in some example embodiments of the garment 100. The superior/inferior control band 130 can curve forming a curvature 130*a* that protrude into the central region 114 between the breast areas 105.

In one implementation, the modules that are part of the front structure 107 and/or the modules part of the back reinforcing structure 109 can have unique structural properties that are engineered to provide better support and management of the breast acceleration. The structural properties of each module can be engineered and designed based on the unique anatomy of the wearer. For example, in one embodiment of the garment 100, the support provided by the lateral module and the central module can be greater than the support provided by the base and chest modules, such that such garment can be more suitable for wearer with more mediolateral breast acceleration during activity. In another example embodiment of the garment 100, the base and chest modules can be designed to provide greater support than the support provided by the central or the lateral modules, for wearer that may need more support and dampening in a vertical direction (e.g., in case of vertical acceleration of the breasts).

The reinforcing element 110 of the front structure 107 can be engineered and designed to provide the modular structure of the front reinforcing structure 107. For example, the portion of the legs 111 in the chest region 112 that traverses at the top of each breast can have the same or different structural properties than the portion of the legs 111 in the base region 118 of each breast or in the lateral region 116, or in the central region 114. Vice versa, the structural properties of any portion/region of the reinforcing frame 108 can be the same or can differ from the other parts/regions of the frame 108. As illustrated in FIG. 2, the legs 111 of the central reinforcing element 110 crisscrosses in the central region 114 and extend around the base and side of each breast area 105 providing support for the breast tissue at the root of the breast. The portion of the legs 111 in the chest region 112 can be positioned to move around the top of the breast tissue and anchors the root of the breast tissue (the area where the breast tissue attaches to the torso) instead of being positioned straight across the top of the breast tissue. Similarly, the under-breast portion of the legs 111 is designed to provide support around the underside of the root of the wearer's breast tissue, and thereby limit accelerating movements in the downward direction. In some implementations, the reinforcing frame 108 can be integral with the garment 100. For example, the garment 100 with the reinforcing frame 108 can be knitted using any suitable knitting technique. The reinforcing frame 108 can be knitted using a stiffer material (or different stiches) than the rest of the garment 100. In one embodiment, some portions (modules) of the reinforcing frame 108 can be knitted with a material that is stiffer than the material used to knit other modules. For example, the lateral and/or base regions of the reinforcing frame 108 can be knitted with a stiffer material than the chest and/or central regions. The modules of the modular embodiment of the reinforcing frame 108 can have properties engineered to match unique need of the wearer and wearer's unique breast acceleration pattern during sport activity.

Figure 3:
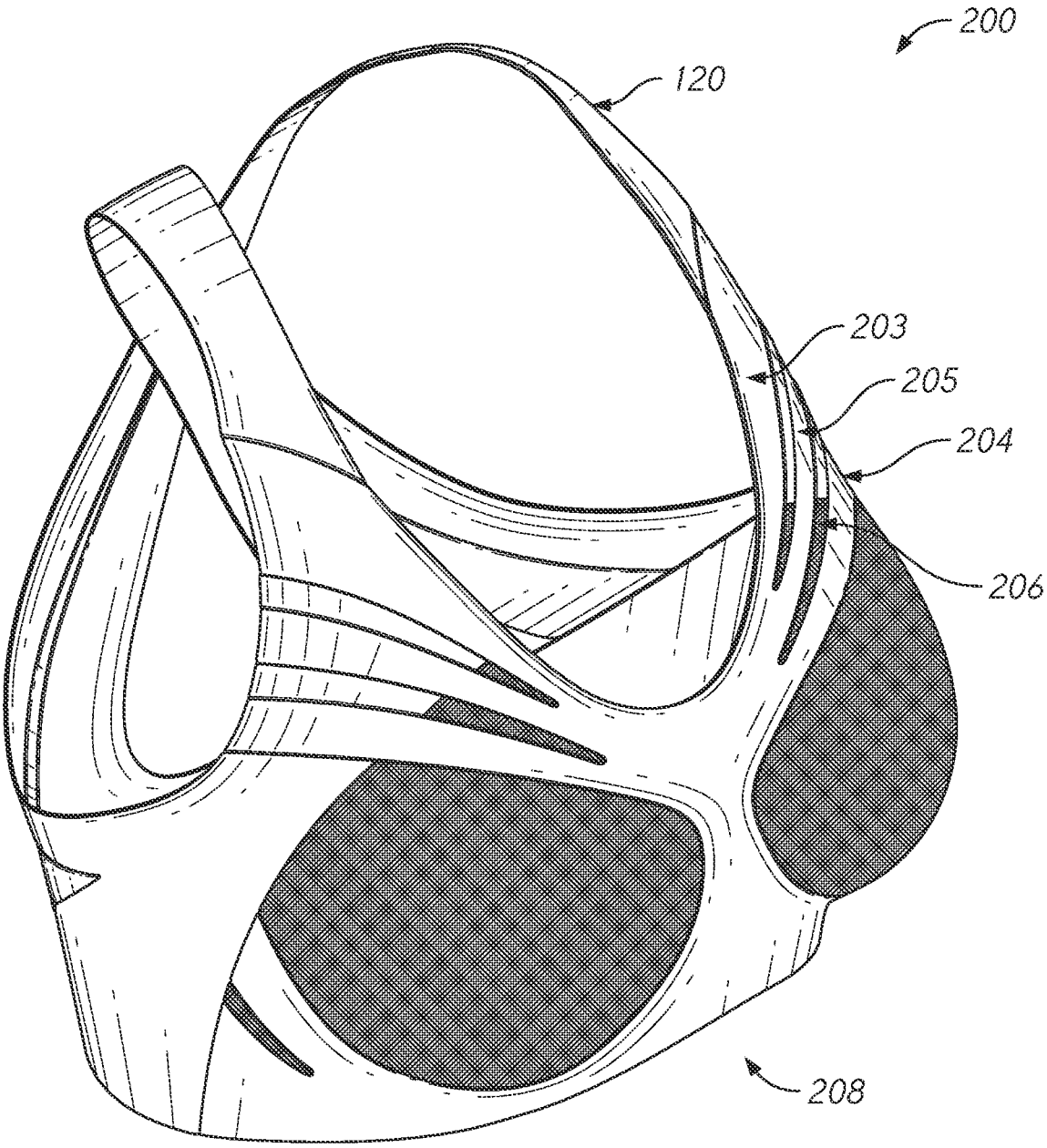
FIG. 3 is a perspective view of an example embodiment of a breast support garment showing a reinforcing frame.
Figure 4:
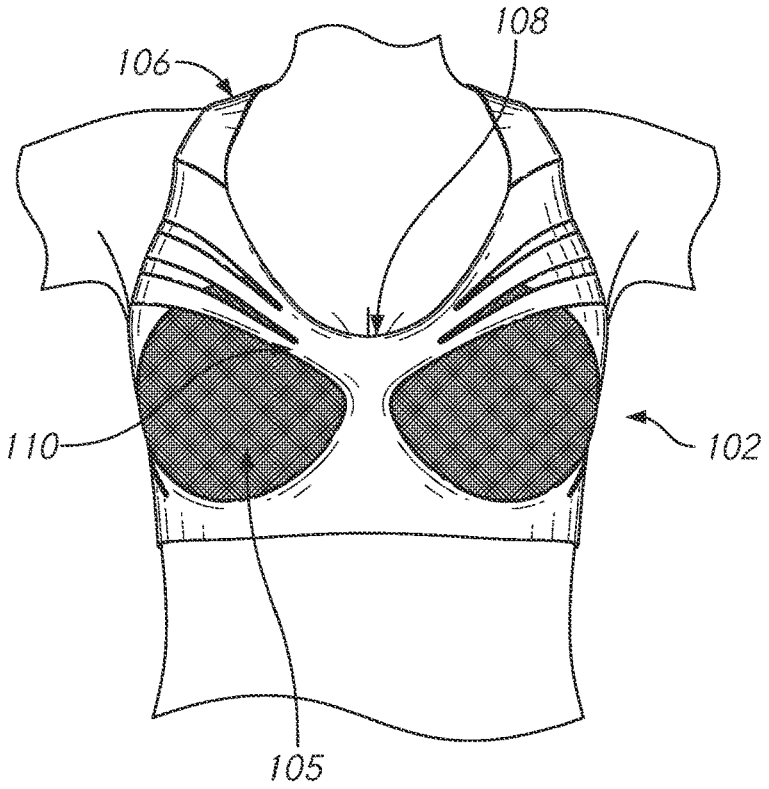
FIG. 4 is a front view of an example embodiment of the breast support garment of FIG. 3.
Figure 5:
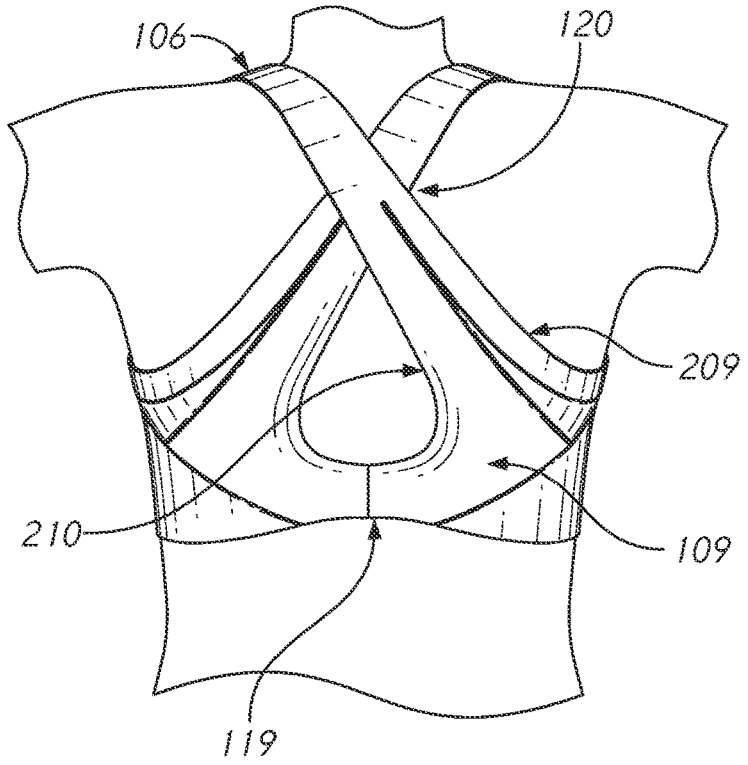
FIG. 5 is a rear view of an example embodiment of the breast support garment of FIG. 3.

In some implementations, some of the modules of the reinforcing frame can include a number of submodules. FIGS. 3-5 illustrate a reinforcing frame 208 with a plurality of submodules. For example, the chest region of the reinforcing frame 208 can be engineered to comprise a plurality of submodules. Such as for example, an upper chest band 203 and a lower chest band 204. The submodules can have same or different structural properties. For example, the upper and the lower chest bands can have different structural properties and can thereby apply different level of pressure to the breast tissue. One or more additional middle chest bands 205 can also be provided with same or different structural properties. In one implementations, all of the chest bands 203-205 can be made of the same material (same structural properties) and the size of the openings 206 therein between can be used to adjust the pressure distribution applied by the chest module.

The reinforcing frame 208 can have a plurality of submodules in some or all of the regions. For example, the back reinforcing structure 109 can comprise the strap region 120 that can further comprise an outer back strap 209 and an inner back strap 210 (see FIG. 5). In the illustrated example, only the back portion of the strap region 120 comprises an outer strap 209 and inner strap 210, however persons skilled in the art understand that the front portion of the strap region 120 can also include inner and outer straps without departing from the scope of the invention. In one implementation, the reinforcing frame can have a support structure similar to a pressure-distributing frame 100 described in the co-pending U.S. patent application Ser. No. 15/720,555 incorporated by reference herein in its entirety. In the example illustrated in the figures, the pair of straps 106 are crossing at the back of the torso, however persons skilled in the art would understand that the straps can be straight or can include additional straps without departing from the scope of the invention. Some modules of the reinforcing frame 108, 208 can be locked-out (not stretchable) while other can be 2-way stretch or 4-way stretch depending on their position. In general, the modules/submodules of the reinforcing frame 108, 208 located near the root of the breast can have an increased value (increased support value), while other locations, such as the straps and the underband, can have a lower value. For example, the pressure values at outer strap, inner strap and a under band can measure less than or equal to 10 mmHg, for optimal comfort of the wearer. Limiting the pressure at these bands and straps of the breast support garment minimizes the wearer's perceived distractions while allowing the load to be distributed effectively across the wearer's torso.

Figure 6:
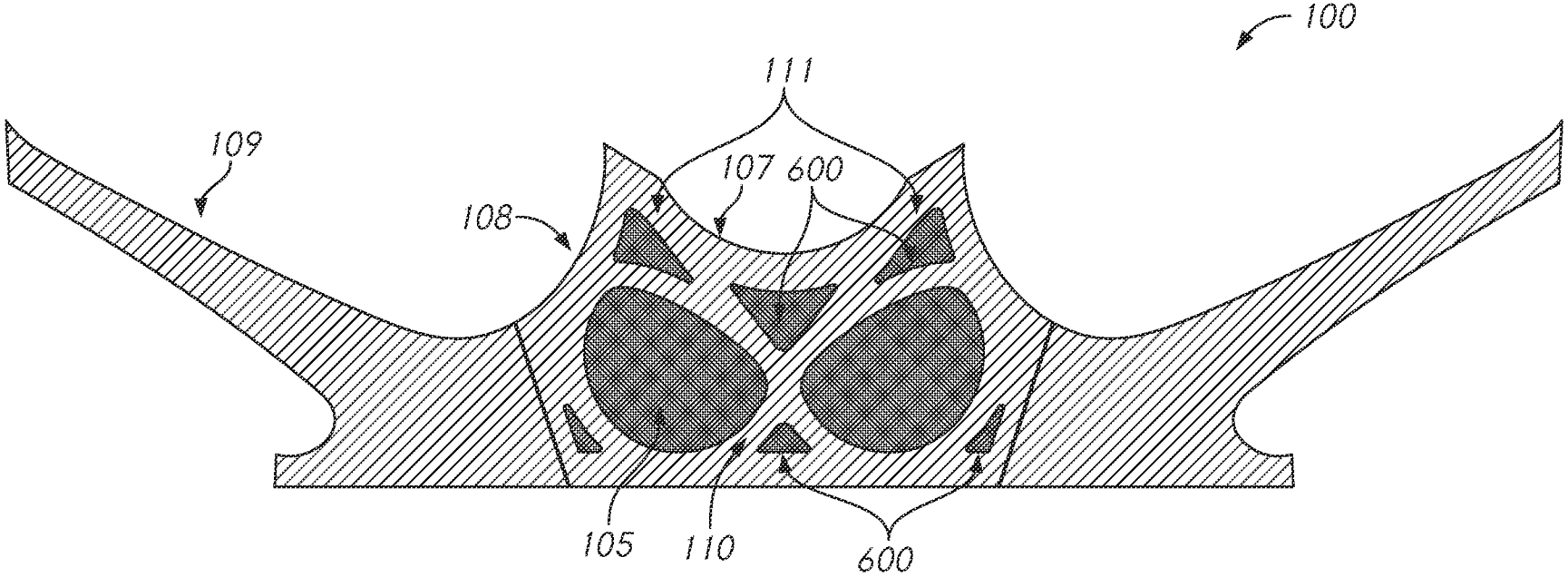
FIG. 6 shows an example of a reinforcing frame for pressure distribution with a front reinforcing structure and a back reinforcing structure.

The reinforcing frame 108, 208 can be constructed as a single piece through a knitting process where different modules can be knitted with the same or different yarn and/or stiches, or can be cut from a material that has the desired reinforcing properties or can be cut and saw/bond of different materials with same or different structural properties. For example, the reinforcing frame or one or more of its modules can be a mesh fabric, a knit fabric, a low Poisson's ratio fabric, a woven fabric or a non-woven fabric. FIG. 6 illustrates a breast support garment 100 where a front reinforcing structure 107 is a single piece made by cutting a suitable reinforcing material or by knitting. The modular structure of the front reinforcing structure can be provided by providing a number of openings 600 into one or more of the regions of the front reinforcing structure 107. The structural properties of each of the regions of the front reinforcing structure 107 can be modified by changing the number, shape, size or position of the openings 600 or by using different yarns and/or stiches in case of knitted reinforcing frame 108.

Figure 7:
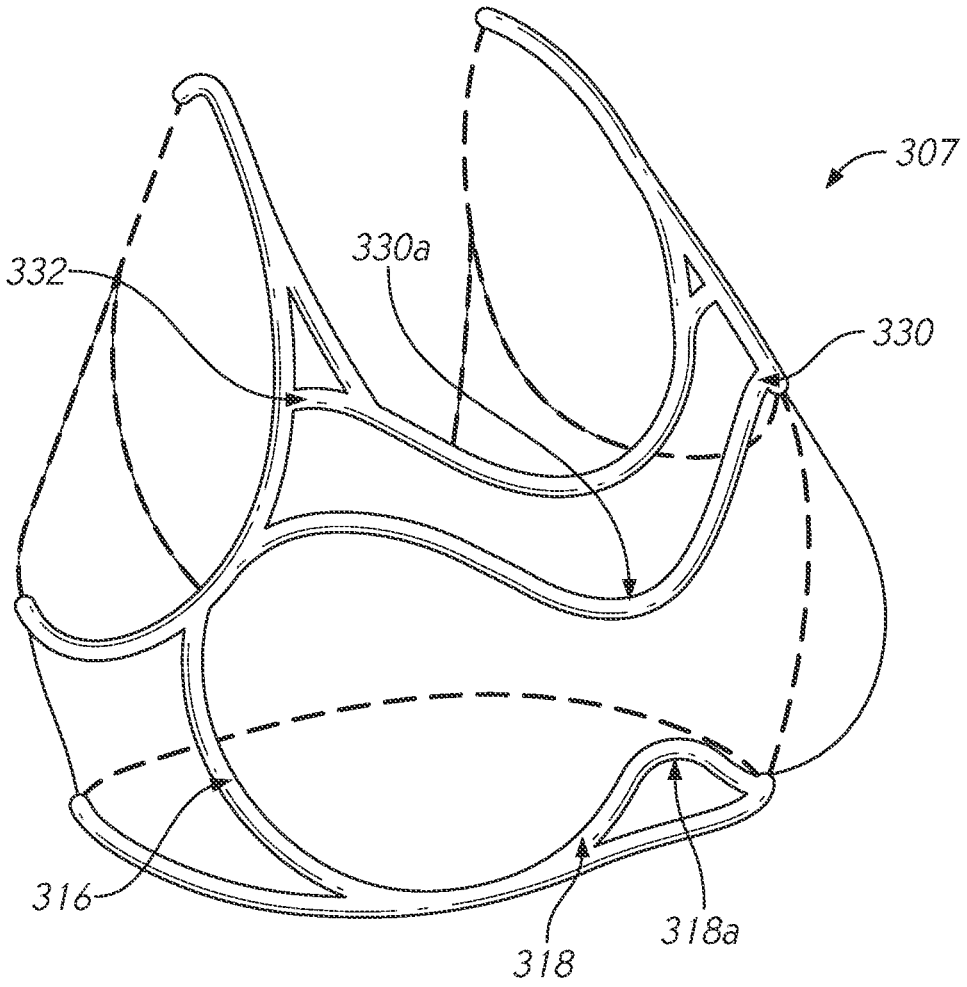
FIG. 7 is an isometric perspective view of an example of another embodiment of a breast support garment with an upper and lower superior/inferior control bands.

FIG. 7 illustrates another embodiment of a reinforcing frame where a front reinforce structure 307 includes an upper superior/inferior control band(s) 330 and 332 that have similar shape as the control band 130 of FIG. 2, and a lower superior/inferior control band 318. The upper and the lower control bands can be connected by a lateral band 316 or in some embodiments the lateral band 316 can be omitted. The upper superior/inferior control band can be a double band comprising two bands 330, 332 that can be separated or adjoining. A central part 318*a* of the lower superior/inferior control band 318 can curve upwardly between the breasts approaching a curvature 330*a* of the upper superior/inferior control band 330. In some embodiments, the curvature 330*a* of the upper superior/inferior control band 330*a* and the curvature 318*a* of the lower superior/inferior control band 318 can be adjoined.

Figure 8:
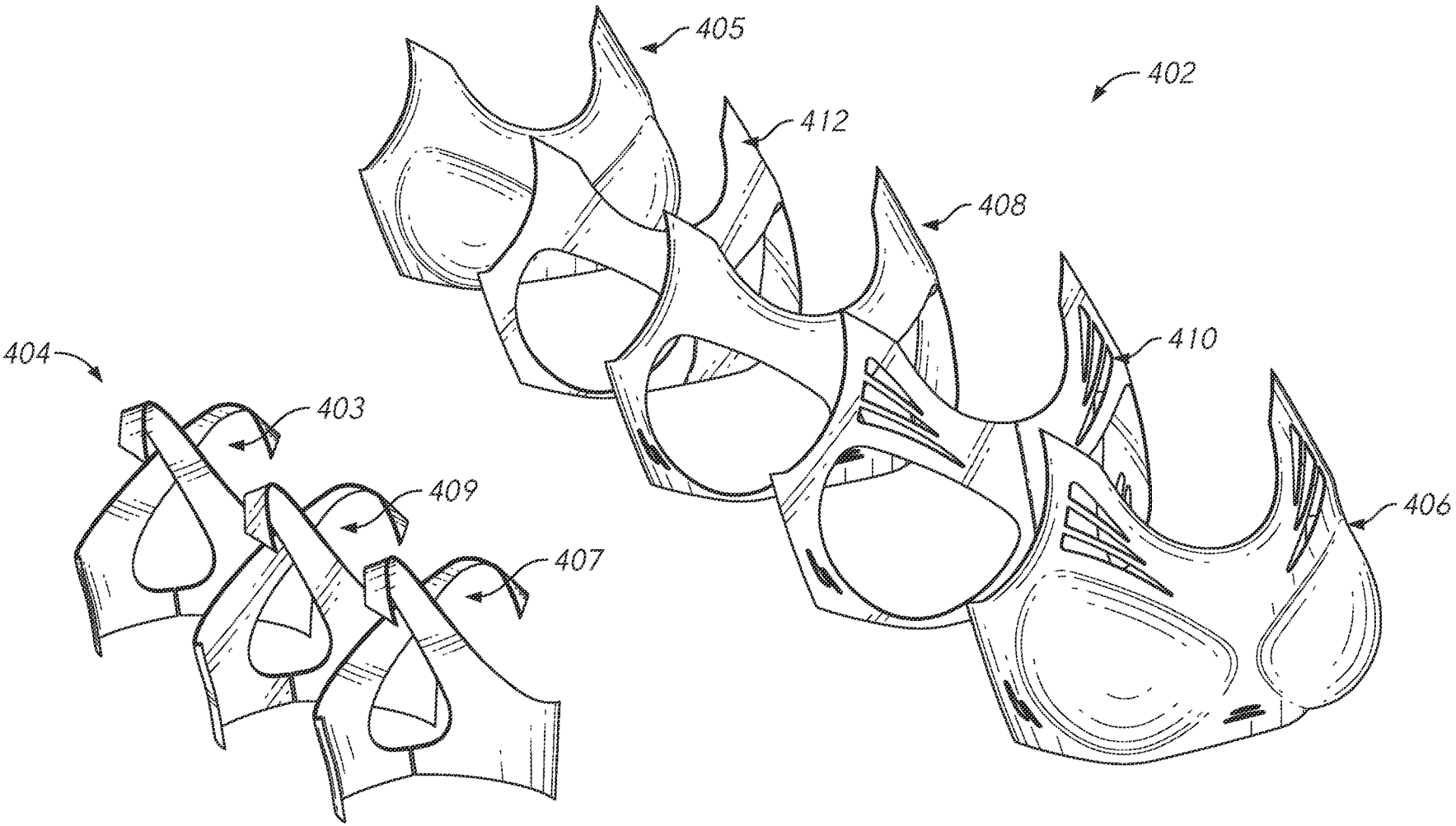
FIG. 8 is an exploded perspective view of an example embodiment of a breast support garment showing a back panel (view on the left) and a front panel (view on the right).

The back reinforcing structure 109 can be bonded to the outer or the inner surface of the back panel or it can be a middle layer in a laminated type of a back panel 104. The back reinforcing structure 109 can be attached to the front structure by sawing or bonding or optionally it can be an integral single piece with the front structure 107. The reinforcing frame 108, 208 and/or the back reinforcing structure 109 can be bonded to the outer or the inner surface of the garment 100, 200 (e.g., its front and back panels) or it can be a middle layer when the front and/or the back panel of the garment 100, 200 is laminated by bonding multiple layers. In some implementations, the reinforcing frame 108, 208 can be a stretch adhesive (for example, a polyurethane adhesive). The adhesive can be printed, extruded or topically applied to the front and the back panels of the breast support garment 100, 200. In another implementation, the reinforcing frame can be a silicon or any suitable elastic material that can be printed, extruded or topically applied to the front and the back panels of the athletic garment. FIG. 8 depicts an exploded view of an example of the breast support garment showing a front panel 402 (view on the right) and a back panel 404 (view on the left). The front panel 402 can comprise an inner layer 405 facing the wearer's body, an outer layer 406 (the layer further away from the wearer's body) and a reinforcing frame 408. An adhesive layer 410 can be used to bond the reinforcing frame 408 to an inner side of the outer layer 406 and an adhesive 412 can be used to bond the reinforcing frame 408 to the inner layer 405. In some embodiments, one of the inner or outer layers 405, 406 or part or parts of the inner or outer layers 405, 406 can be meshed to provide improved breathability. The inner layer 405 can be molded foam or a fabric. In one implementation, the inner and/or the outer layers 405, 406 can be a spacer fabric, a warp or weft knitted fabric with or without Lycra, a low Poisson's ratio fabric or any other suitable knitted or woven or non-woven fabric. The adhesive layers can be a glue layer or any other suitable adhesive. The adhesive layers 410, 412 can provide additional stiffness to the reinforcing frame 408. The back panel 404 can include an inner layer 403, an outer layer 407 and a reinforcing back structure 409. The reinforcing back structure can be an adhesive layer as illustrated in FIG. 8 or a silicon or any other suitable fabric or material.

Figure 9:
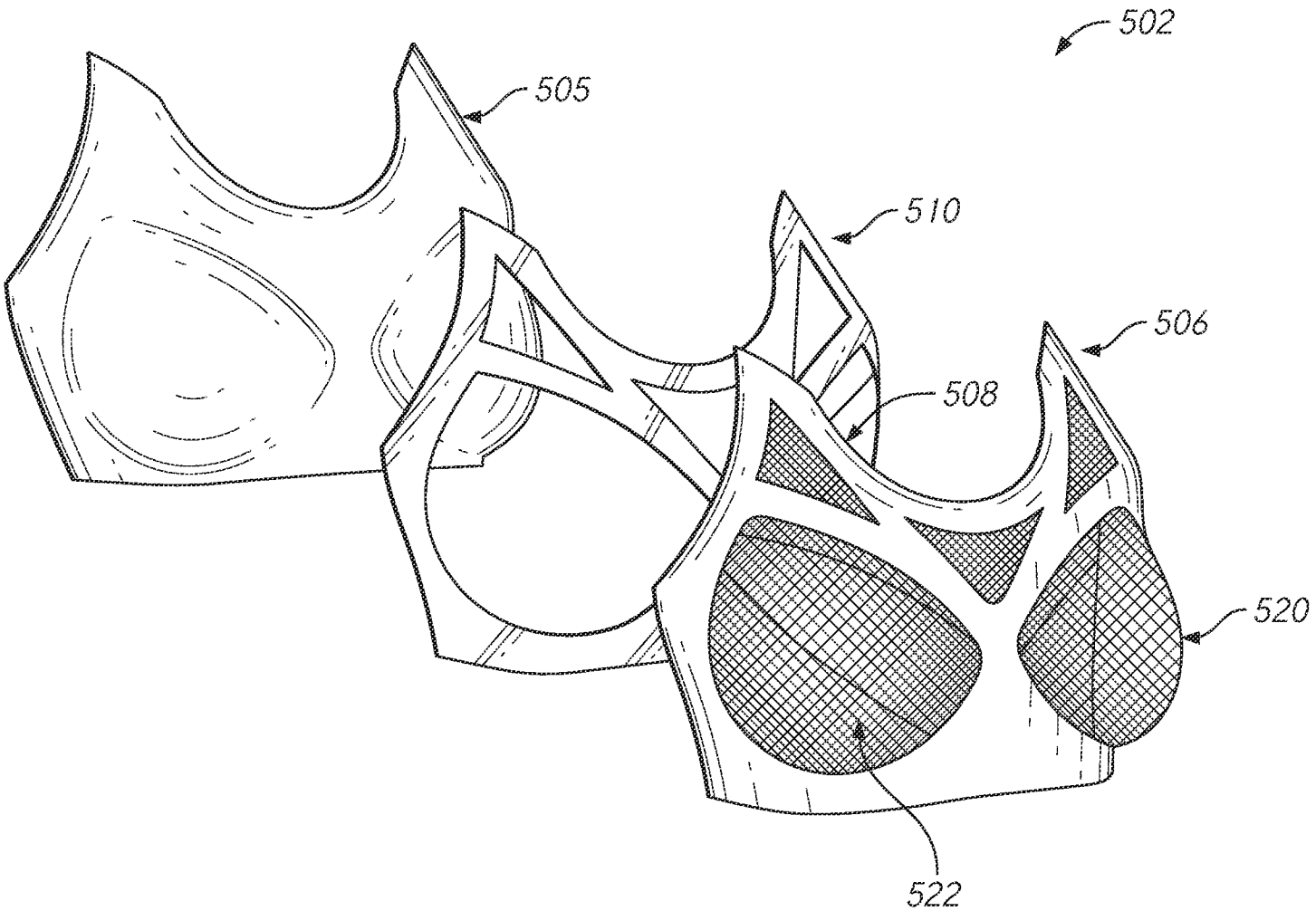
FIG. 9 is an exploded perspective view of another example embodiment of a breast support garment showing an example of a front panel.

In one implementation, at least one of the outer or the inner layer can have a modular structure where one of the module of the outer or the inner layer is designed to match with a shape of the front reinforcing structure. In such case the front reinforcing structure can be a reinforcing adhesive that is bonded to such modular outer or inner layer. FIG. 9 for example illustrates a front panel 502 with a modular outer layer 506 that integrates the module 508 that matches with the front reinforcing structure and such module is integrated within the outer layer into a single piece. For example, the outer layer 506 with the module 508 can be 3D knitted using any suitable known knitting technique. In one implementation, the outer layer 506 with the reinforcing module 508 can be flat knitted and then it can be molded to form the breast areas 520. The inner and the outer layer 505 and 506 can be bonded together during the molding process. An adhesive reinforcing frame 510 can be provided for additional reinforcing around the root of the breast tissue. In one embodiment, the reinforcing frame can have a gradual support profile. For example, FIG. 9 shows the gradual reinforcing profile 522 in the lateral and base regions where the support values of the reinforcing module 508 decrease away from the lateral and base regions into the breast area 520. Only one region of the reinforcing frame or two or more regions of the reinforcing frame can have gradual reinforcing profile.

Figure 10D:
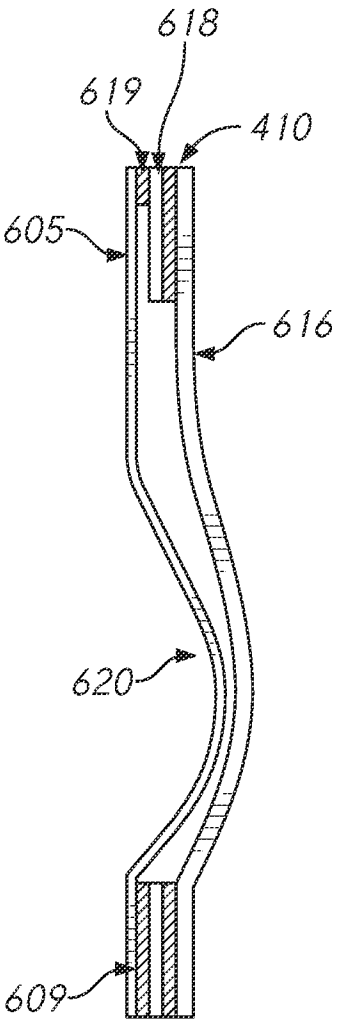
FIGS. 10A-10H show a side cross-sectional view of eight example embodiments of a front panel of the breast support garment.
Figure 10C:
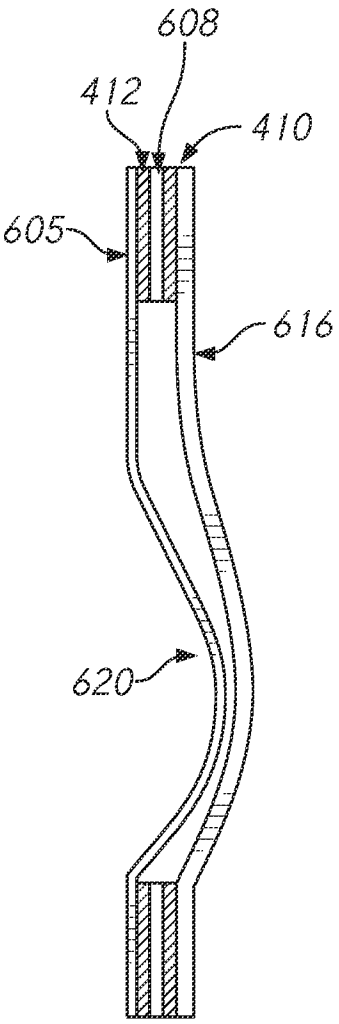
Figure 10B:
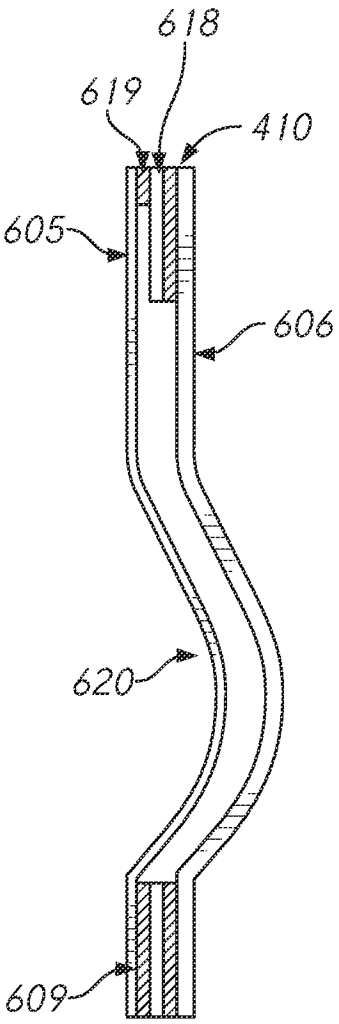
Figure 10A:
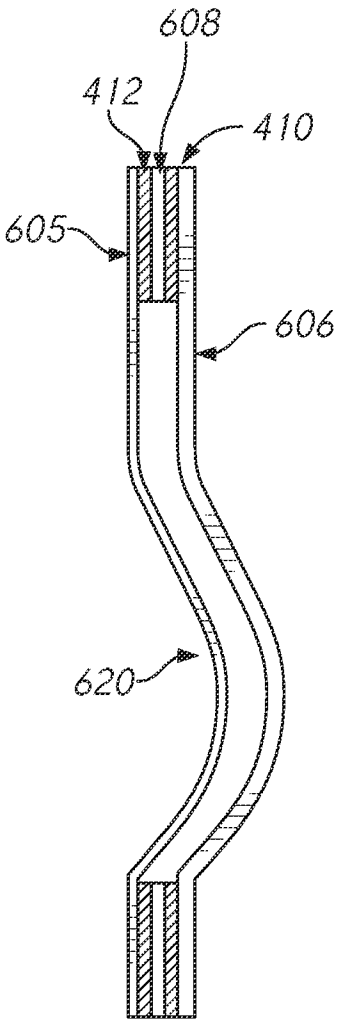
Figure 10H:
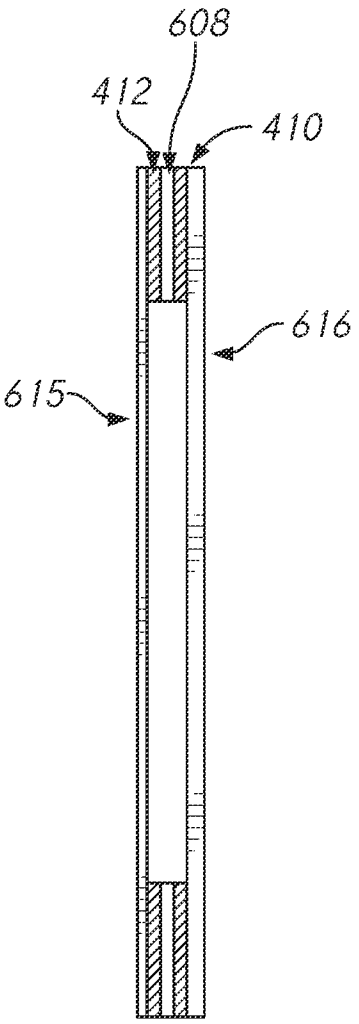
Figure 10G:
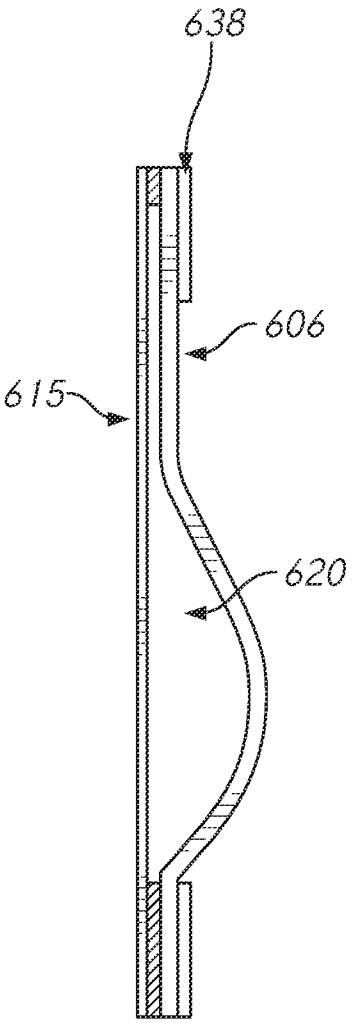
Figure 10F:
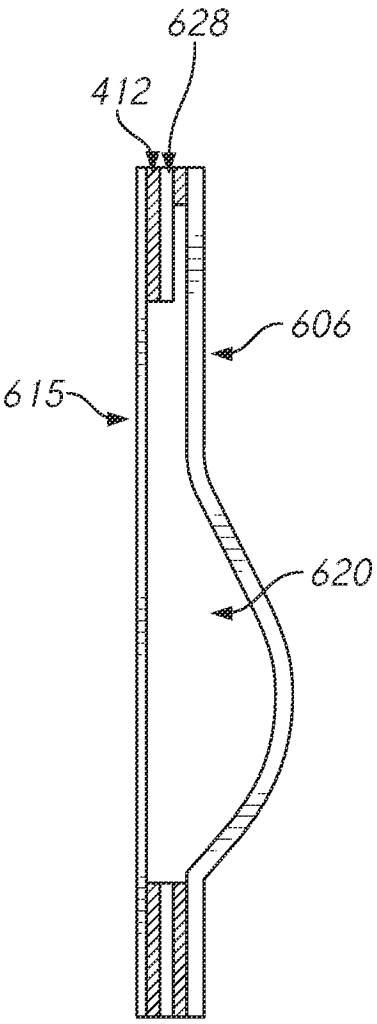
Figure 10E:
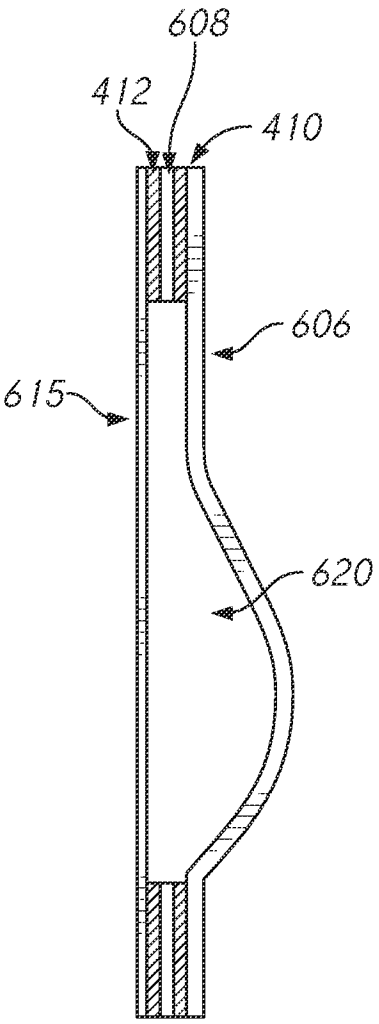

FIGS. 10A-10H illustrate a number of different examples of the front panel with an inner layer 605, 615, an outer layer 606, 616 and a reinforcing frame 608, 618, 628, 638. The example of the front panel illustrated in FIGS. 10A and 10B has inner and outer layers 605, 606 both molded to form the two breast areas 620. FIG. 10A shows the reinforcing frame 608 that is bonded to both the inner and the outer layers 605, 606 using the adhesive layers 410 and 412 that are similar to the adhesive layers described herein above with respect to FIG. 8. The adhesive layers 410, 412 can provide additional reinforcing support. In some implementations, the reinforcing frame can be bonded only to one of the outer or the inner layers. For example, FIGS. 10B and 10D illustrate an example of the garment where a reinforcing frame 618 is bonded to the outer layer 606, 616 however the inner layer 605 is not bonded to the reinforcing frame 618. The inner layer 605 is bonded to the outer layer 606, 616 at the underband 609 and the edge perimeter 619 of the front panel but is not bonded to the frame 618 (the adhesive layer 412 is omitted in such embodiments). Similarly, FIG. 10F illustrate another example where a reinforcing frame 628 is bonded to an inner layer 615 using an adhesive layer similar to the adhesive layer 412 but is not bonded to the outer layer 606 (adhesive layer 410 is being omitted). FIG. 10G illustrates another example of a garment where the inner and the outer layers 615, 606 are bonded together and the reinforcing frame 638 is applied on an outer surface of the outer layer 606. The frame 638 can be a fabric that can be bonded on the outer surface of the outer layer 606 or can be a silicone or any thermoplastic material that can be printed or applied on the outer surface of the outer panel. In some implementations, one or both of the inner and the outer layers can be a flat panel. For example, FIGS. 10C and 10D illustrate a front panel where only the inner layer 605 can be molded forming the cup areas 620 while the outer layer 616 can be a flat panel, while FIGS. 10E, 10F and 10G illustrate a front panel where the inner layer can be a flat panel 615 and the outer layer can be a molded panel 606 forming the breast cup areas 620. With respect to the example of front panel illustrated in FIG. 10H both the inner and the outer layers 615, 616 can be flat panels. The breast support garment of the present invention can include any other combination of the described inner 605, 615, and outer layers 606, 616 and reinforcing frame 608, 618, 628, 638 without departing from the scope of the invention.

In one method of manufacture, such as for example, to manufacture the embodiment illustrated in FIG. 10A, the outer layer 606 can be pre-molded to form the breast cup areas 620 and is then positioned into a cavity side of a molding tool (e.g., any generally known molding tool). The adhesive layer 410 (e.g. a hot melt adhesive) can be pre-applied to a silicone sheet. In one implementation, a silicone sheet with an adhesive can be positioned on each side of a reinforcing frame 608 which is then molded so that the adhesive is transferred into the frame 608 and the silicone sheets are peeled off. Then the frame is bonded to the outer layer 606. An alignment means can be used to position the reinforcing frame 608 to a pre-determined region of the pre-molded outer layer 606. The bonding of the frame 608 to the outer layer 606 can be done at a temperature of about 110-150 degrees Celsius for about 20-40 seconds, applying force of about 2.2 kN. Once the frame 608 is bonded to the outer layer 606, the pre-molded inner layer 605 is positioned over the frame 608 and bonded to the frame 608. In another method of operation, the silicone sheet with an adhesive layer can be first molded over the outer layer so that the adhesive is transferred into the outer layer, then the frame can be bonded therein and then another silicone sheet with adhesion is positioned over the frame and is molded in order to transfer the adhesive into the frame and the inner layer is bonded thereon. The outer and the inner layers can be pre-molded or flat panels and the reinforcing frame can be bonded to the outer layer or the inner layer or both layers as described herein above with respect to the FIGS. 10A-10H using the method described herein or a variation of such method.

Although a number of example embodiments of the invention have been described, it should be understood that numerous other modifications and embodiments of the invention can be devised by those skilled in the art that will fall within the scope of the principles of this disclosure. More particularly, various variations and modifications are possible in the component parts and/or arrangements of the inventive subject matter within the scope of the disclosure, the drawings, and the appended claims. In addition to variations and modifications in the component parts and/or arrangements, alternative uses and applications of the invention will also be apparent to those skilled in the art.

What is claimed is:

1. A breast support garment comprising:

a front panel configured to cover at least a portion of a wearer's chest;

a pair of straps each having a first end connected to the front panel; and a reinforcing frame comprising a front reinforcing structure connected to the front panel and defining two breast areas, the front reinforcing structure comprising a central reinforcing element with two crisscrossing legs configured to extend from a chest region of a first breast to an under-breast region of an opposite breast thus separating the two breast areas, each of the leg of the central reinforcing element having a top end that is in contact with the first end of the respective strap, and a back reinforcing structure connected to the pair of straps, wherein the front reinforcing structure being shaped to support breast tissue directly around a root of each breast.

2. The breast support garment according to claim 1, wherein the central reinforcing element is configured to provide a direct linear connection between the breast areas and the pair of straps diagonally with respect to the breast areas, and therefore is configured to support breast tissue directly around a root of each breast of the wearer.

3. The breast support garment according to claim 1, wherein the front reinforcing structure is configured to conform wearer's breast shape.

4. The breast support garment according to claim 1, wherein the front reinforcing structure is a single piece with a pre-defined structural property.

5. The breast support garment according to claim 1, wherein the front reinforcing structure comprises a modular structure, wherein the modular structure comprises a chest module, a base module, and a lateral module.

6. The breast support garment according to claim 5, wherein at least one of the modules of the front reinforcing structure has a structural property that is different than a structural property of the other modules.

7. The breast support garment according to claim 5, wherein at least one of the modules of the front reinforcing structure is configured to extend into a portion of the two breast areas and comprises a gradual reinforcing profile, wherein a support value of such gradual reinforcing profile decreases as it extends into the breast areas.

8. The breast support garment according to claim 5, wherein at least one of the modules of the front reinforcing structure is comprised of a number of sub-modules, wherein at least one of the sub-modules has a structural property different than the other sub-modules.

9. The breast support garment according to claim 1, wherein the front reinforcing structure further comprises at least one superior/inferior control band configured to dampen breast acceleration in a vertical direction.

10. The breast support garment according to claim 1, wherein the back reinforcing structure has a modular structure comprising a number of modules and wherein at least one of such modules has a structural property that is different from that of the other modules.

11. The breast support garment according to claim 1, wherein the front reinforcing structure has a first structural property providing a first amount of support and the back reinforcing structure has a second structural property providing a second amount of support, the first amount of support being greater than the second amount of support.

12. The breast support garment according to claim 1, wherein the reinforcing frame is integrated with the garment.

13. The breast support garment according to claim 1, wherein the reinforcing frame is made of an adhesive and/or a material selected from a group of a mesh fabric, a knit fabric, a low Poisson's ratio fabric, a woven fabric and a non-woven fabric.

14. The breast support garment according to claim 1, wherein the front panel further comprises an outer layer and an inner layer, the inner layer facing the wearer's chest, the front reinforcing structure being positioned between the inner and the outer layer.

15. The breast support garment according to claim 14 further comprising a first reinforcing adhesive positioned between the outer layer and the front reinforcing structure and a second reinforcing adhesive positioned between the inner layer and the front reinforcing structure, the first reinforcing adhesive used to bond the front reinforcing structure to the outer layer and second reinforcing adhesive being used to bond the front reinforcing structure to the inner layer.

16. The breast support garment according to claim 14, wherein at least one of the outer or the inner layer having a modular structure having a first module that is configured to match a shape of the front reinforcing structure, and wherein the front reinforcing structure is a reinforcing adhesive.

17. The breast support garment according to claim 16, wherein the first module comprises a gradual reinforcing profile wherein a support value of the gradual reinforcing profile decreases as it extends into the breast areas.

18. The breast support garment according to claim 16, wherein the at least one of the outer or the inner layer is knitted, wherein the first module is knitted with a different yarn or stitch type than the other modules of such modular structure.

19. The breast support garment according to claim 14, wherein at least one of the outer or the inner layer is molded to form two breast cups, the front reinforcing structure following contours of each breast cup.

20. The breast support garment according to claim 14, wherein both the outer and the inner layer are molded to form two breast cups.

21. The breast support garment according to claim 14, wherein at least one of the outer or the inner layer comprises a flat panel.

22. The breast support garment according to claim 14, wherein both the outer and the inner layer comprise flat panels.

23. The breast support garment according to claim 14, further comprising a first reinforcing adhesive positioned between the outer layer and the front reinforcing structure to bond the front reinforcing structure to the outer layer, the inner layer being bonded to the outer layer at an edge perimeter of the front panel.

24. The breast support garment according to claim 14, further comprising a second reinforcing adhesive positioned between the inner layer and the front reinforcing structure to bond the front reinforcing structure to the inner layer, the inner layer being bonded to the outer layer at an edge perimeter of the front panel.

25. The breast support garment according to claim 14, wherein the front reinforcing structure is connected to an outer surface of the outer layer.

* * * * *